United States Patent [19]

Mueller

[11] Patent Number: 5,025,847

[45] Date of Patent: Jun. 25, 1991

[54] APPARATUS FOR ACCOMMODATING APPLICATION OF A FORCE IN EXCESS OF A PREDETERMINED MAGNITUDE AND CLOSURE EMPLOYING SUCH APPARATUS

[75] Inventor: Louis B. Mueller, Richfield, Wis.

[73] Assignee: Rytec Corporation, Chicago, Ill.

[21] Appl. No.: 587,539

[22] Filed: Sep. 21, 1990

Related U.S. Application Data

[63] Continuation-in-part of Ser. No. 520,980, May 9, 1990, abandoned, which is a continuation-in-part of Ser. No. 372,279, Jun. 27, 1989, abandoned.

[51] Int. Cl.[5] ..... E06B 9/17

[52] U.S. Cl. ..... 160/270; 160/133; 160/265

[58] Field of Search ..... 160/265–289, 160/133, 23.1

[56] References Cited

U.S. PATENT DOCUMENTS

| | | | |
|---|---|---|---|
| 1,033,224 | 7/1912 | Andlauer | 160/274 |
| 1,922,389 | 8/1933 | Nye | 160/273.1 |
| 3,797,553 | 3/1974 | Elliott | 160/267.1 |
| 3,878,879 | 4/1975 | Manns | 160/273.1 |
| 4,478,268 | 10/1984 | Palmer | 160/272 X |
| 4,690,195 | 9/1987 | Taylor | 160/265 X |
| 4,800,946 | 1/1989 | Rosenoy | 160/133 X |

FOREIGN PATENT DOCUMENTS

| | | | |
|---|---|---|---|
| 2016066 | 9/1979 | United Kingdom | 160/133 |

*Primary Examiner*—David M. Purol

*Attorney, Agent, or Firm*—Foley & Lardner

[57] ABSTRACT

An apparatus configured for maintaining a barrier in a position against a trans-barrier force less than a predetermined magnitude. The barrier has associated structures for cooperating with the apparatus to define the position in which the barrier is maintained.

The apparatus comprises a guide follower attached to the barrier and operatively interactive with the associated structures for defining the barrier position. The guide follower of the apparatus comprises a first portion attached to the barrier and a second portion operatively interactive with the associated structures. The first portion and the second portion are in an interfitting relation and define at least one pair of mating surfaces, each of which mating surfaces is transverse to the barrier and oriented to allow sliding disengagement of the first portion and the second portion in response to application of a trans-barrier force to the barrier in excess of a predetermined magnitude.

44 Claims, 6 Drawing Sheets

250
206
210
212
254
252
220
214
256
242
208
218
246
240
216
238
248
256
244
215
222
252
250
254
213
236

APPARATUS FOR ACCOMMODATING APPLICATION OF A FORCE IN EXCESS OF A PREDETERMINED MAGNITUDE AND CLOSURE EMPLOYING SUCH APPARATUS

This is a continuation-in-part of application Ser. No. 07/520,980, filed May 9, 1990, abandoned, which is a continuation-in-part of application Ser. No. 07/372,279 filed June 27, 1989, abandoned.

BACKGROUND OF THE INVENTION

The present invention is directed to an apparatus configured for use with a door or other barrier for maintaining the door or other barrier in a position and capable of resisting a trans-barrier force less than a predetermined magnitude. When the trans-barrier force exceeds the predetermined magnitude, the apparatus is designed to yield and allow the barrier to move in response to the trans-barrier force, thereby avoiding damage to the barrier and, further, avoiding damage to adjacent supporting structures for the barrier, such as guide rails, supports, tensioning mechanisms, and the like.

The preferred embodiment of the present invention is particularly adaptable for use with a door of the roll-up type which is generally used for environmental control between two spaces, such as between sections of a warehouse, or the like. In such doors, a motor-driven roller controls the upward and downward movement of the door to control access through an opening. An assembly of cables, associated pulleys, and tension springs serves as a tensioning mechanism. The tensioning mechanism is driven by the roller motor and connected to a guide follower apparatus. The guide follower apparatus is attached to the bottom, or leading edge, of the roller door and interacts with guide rails adjacent the opening. In such installations, the door is generally flexible and is kept under tension to aid in maintaining alignment of the door with respect to the guide rails and the opening.

It is common that such door installations are subjected to abuse during normal operations by the impact of machinery, such as fork lifts, with the bottom (leading edge) of the door. In previous designs, such abuse inflicted serious damage to the door and its associated guide rails, tensioning mechanism, and other parts. Such damage often jammed the door in its down (closed) position, causing serious delays in operations in spaces about the door since the door blocked access through the opening.

Previous efforts have been made to accommodate these destructive forces accidentally imparted to such doors. One solution has been to provide a hinged guide rail so that application of force to the door causes the hinged panel of the guide rail to pop loose and rotate away from the guide follower attached to the bottom, leading edge, of the door. That swinging open of the guide rail allowed the door and guide follower to swing free in response to the application of the destructive force.

The hinged guide rail solution had problems and shortcomings: the cables in the door tensioning mechanism could snarl, stretch, break, or otherwise become damaged; associated pulleys and tension springs of the tensioning mechanism could similarly be damaged; and, perhaps most important, since the guide rails were generally placed adjacent the opening, as opposed to within the opening, the hinged guide rail only accommodated trans-barrier forces in one direction, away from the wall surrounding the opening. Trans-barrier forces applied in the opposite direction (toward the wall) would not operate to pop open the hinged panel of the guide rail and would serve only to drive the door and its associated guide follower against the wall surrounding the opening. Of course, driving the door against the wall caused damage to the guide follower, door, guide rail, tensioning apparatus, and other parts of the door installation.

The present invention is designed to overcome the shortcomings of these previous attempts to provide a trans-barrier force accommodation mechanism to avoid damage to a barrier and its associated structures and mechanisms. In one of its embodiments, the present invention uses a structure which accommodates trans-barrier forces in two directions.

Further, great precision of determination of the predetermined magnitude of the trans-barrier force at which the apparatus will allow the door to yield can be achieved in the present invention through the use of a shear pin-type or similar assembly.

SUMMARY OF THE INVENTION

The invention is an apparatus configured for maintaining a barrier in a position against a trans-barrier force less than a predetermined magnitude. The barrier has associated structures for cooperating with the apparatus to define the position in which the barrier is maintained.

The apparatus comprises a guide follower attached to the barrier and operatively interactive with the associated structures for defining the barrier position. The guide follower of the apparatus comprises a first portion attached to the barrier and a second portion operatively interactive with the associated structures. The first portion and the second portion are in an interfitting relation and define at least one pair of mating surfaces, each of which mating surfaces is transverse to the barrier and oriented to allow sliding disengagement of the first portion and the second portion in response to application of a trans-barrier force to the barrier in excess of a predetermined magnitude.

The present invention, therefore, maintains the barrier, such as a roll-up door, in a desired position with respect to the associated structures of the barrier and with respect to the opening through which access is controlled by the barrier. By using the apparatus of the present invention to effect the operative interaction between the barrier and its associated structures, trans-barrier forces applied against the barrier can be accommodated up to a predetermined magnitude without affecting the door. For trans-barrier forces in excess of the predetermined magnitude, the apparatus of the present invention will yield by slidingly disengaging the first portion and the second portion of the apparatus to allow the barrier to be displaced in response to the trans-barrier force. In such manner, the trans-barrier force is not transmitted to the associated structures of the barrier so that damage to the associated structures is avoided.

The predetermined force at which the first portion and the second portion of the apparatus will disengage may be definitively established by the structure of the apparatus. For example, a shear pin may be employed in a manner whereby the shear pin intersects at least one of the mating surfaces defined by the interface of the first portion and the second portion of the apparatus. The shear pin can be designed to shear in response to a force which can be precisely determined by the material, diameter, and other parameters of the shear pin.

Other structural details for establishing the predetermined force at which the first portion and the second portion of the apparatus will disengage include: choice of materials of the interfitting faces of the first portion and second portion of the apparatus which define the mating pairs of surfaces; and treatment of the mating surfaces by providing undulations, ridges, serrations, or other structural features on those surfaces.

It is, therefore, an object of the present invention to provide an apparatus for maintaining a barrier in a position against a trans-barrier force less than a predetermined magnitude, and enabling displacement of the barrier in response to a trans-barrier force in excess of that predetermined magnitude without causing damage to the barrier or to barrier-associated structures.

A further object of this invention is to provide an apparatus for maintaining a barrier in a position against a trans-barrier force less than a predetermined magnitude which can respond to trans-barrier forces in two directions with respect to the barrier without occasioning damage to the barrier or to barrier-associated structures.

Yet a further object of the present invention is to provide an apparatus for maintaining a barrier in a position against a trans-barrier force less than a predetermined magnitude in which the predetermined magnitude can be established with accuracy.

Further objects and features of the present invention will be apparent from the following specification and claims when considered in connection with the accompanying drawings illustrating the preferred embodiments of the invention.

DETAILED DESCRIPTION OF THE DRAWINGS

DETAILED DESCRIPTION OF THE PREFERRED EMBODIMENT

Figure 1:
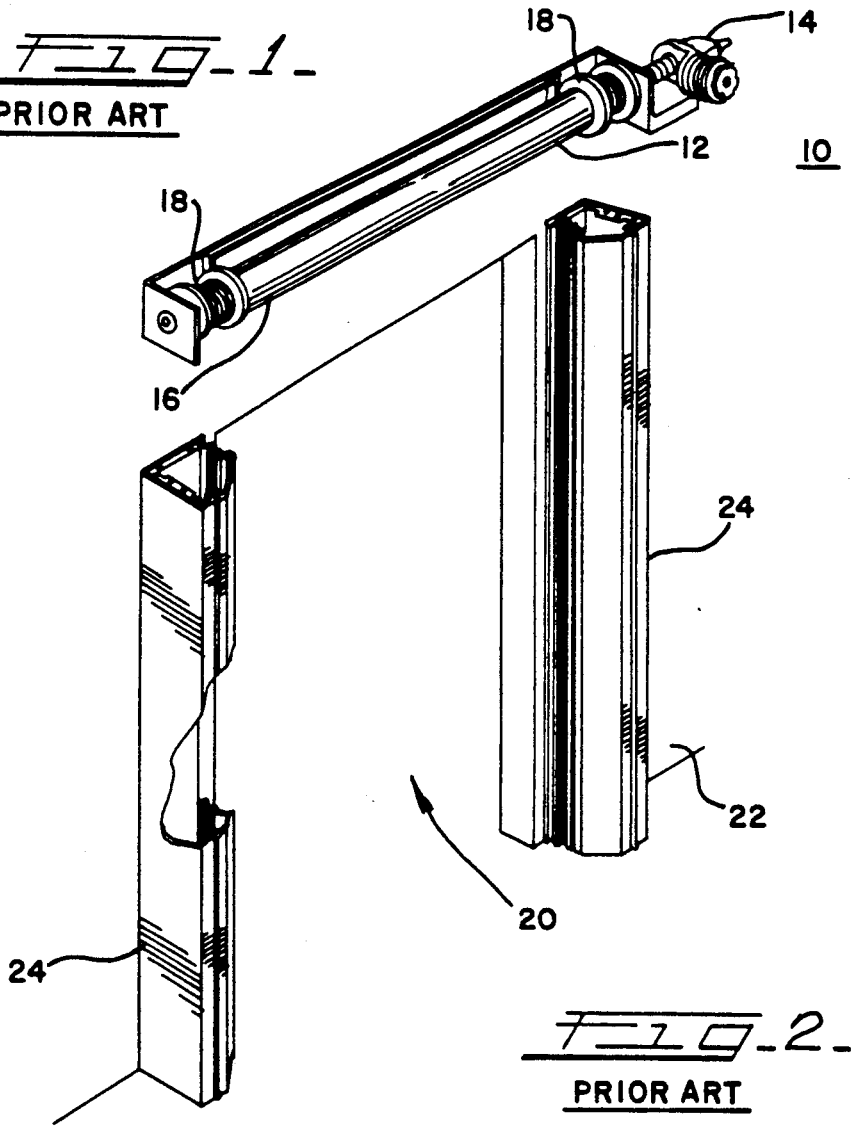
FIG. 1 PRIOR ART
FIG. 1 is an exploded view of a prior art roll-up door of the type contemplated for use with the apparatus of the present invention.

FIG. 1 illustrates the principal elements of a roll-up door assembly 10 in an exploded perspective view. The roll-up door assembly 10 principally consists of a roller 12 directly driven by a motor 14. On the roller 12 is the flexible door 16 and cable reels 18. The roller 12 is situated adjacent an opening 20 in a wall 22. Adjacent the opening 20 and mounted to the wall 22 are guide rails 24.

In operation, the door 16 is rolled and unrolled upon the roller 12 in response to movement of the roller 12 by the motor 14. The door 16 is maintained in a position adjacent the opening 20 by the guide rails 24, in a manner to be described in greater detail hereinafter.

For purposes of clarity and ease of understanding the invention, like elements will be identified by like reference numerals in the various drawings.

Figure 2:
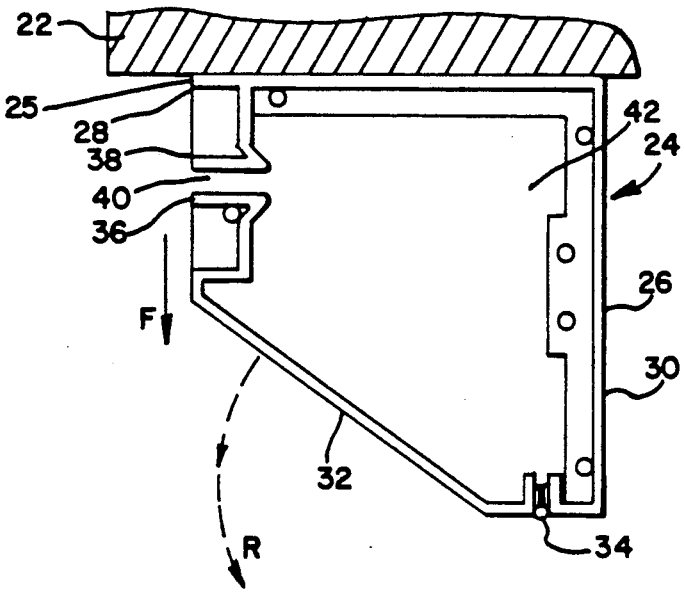
FIG. 2 PRIOR ART
FIG. 2 is a top view of a prior art guide rail assembly with a hinged cover.

In FIG. 2, a top view of a prior art guide rail 24 is illustrated attached to a wall 22. The guide rail 24 comprises a wall 26 of generally L-shape with a first leg 28 affixed to the wall 22 and a second leg 30 depending from the first leg 28. A cover 32 is hinged to the second leg 30 at a hinge 34. The cover 32 presents a guide wall 36 in facing relation to a guide wall 38 depending from first leg 28. The guide walls 36 and 38 define a channel 40 which leads to an interior chamber 42 defined by the wall 26 and the cover 32.

In operation, the door 16 and its associated guide follower (not shown in FIGS. 1 and 2) slidingly travel within the channel 40 so that the guide rail 24 guides the door 16 in a desired orientation with respect to the opening 20 as the motor 14 rotates the roller 12 to move the door 16 upward and downward within the channel 40.

The interior chamber 42 contains the tensioning mechanism (not shown in FIGS. 1 and 2) in a manner to be described in greater detail hereinafter.

The guide rail 24 of FIG. 2 responds to application of a trans-barrier force F applied to the door 16 in a direction away from the wall 22 as follows: as the trans-barrier force F is applied to the door 16, the door 16 will impinge upon the guide wall 36, urging the cover 32 to rotate about the hinge 34 in a direction as indicated by the arcuate arrow R in FIG. 2. Thus, the door 16 will no longer be resisted in its movement in the direction of the arrow F in FIG. 2 by the guide wall 36 and will, therefore, freely swing away from the wall 22 in response to the trans-barrier force F.

Figure 3:
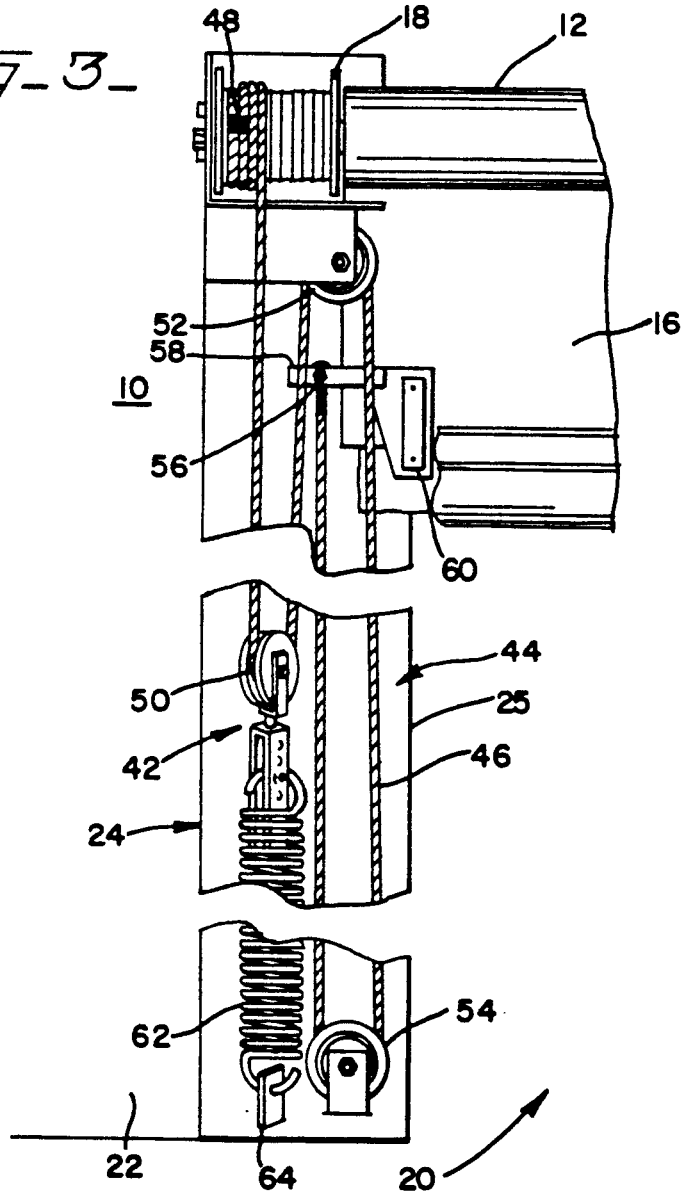
FIG. 3 PRIOR ART
FIG. 3 is a partial schematic view of a prior art roll-up door showing details of a door tensioning mechanism.

A serious shortcoming or the prior art design illustrated in FIGS. 1 and 2 is best illustrated in FIG. 3, a more detailed illustration of one side of a roll-up door assembly 10. In FIG. 3, the guide rail 24 is illustrated with the cover 32 removed to reveal the details of the tensioning mechanism 44.

The tensioning mechanism 44 includes a cable 46 which is attached at a first end 48 to the cable reel 18 on the roller 12. The cable is led through pulleys 50, 52, and 54 and terminates at a second end 56. The second end 56 ia attached to an extension arm 58 of a guide follower 60. The guide follower 60 is attached to the door 16. A tension spring 62 is attached between the pulley 50 and a tab 64 associated with the guide rail 24 to maintain the cable 46 in tension.

As can be seen in FIG. 3, the door 16 and the guide follower 60 extend beyond the inner edge 25 of the guide rail 24. The inner edge 25 is the closest edge to the door 16 of the first leg 28 of the guide rail 24, which first leg 28 is attached to the wall 22 adjacent the opening 20.

As can be seen in FIG. 2, the inner edge 25 is substantially co-terminous with one end of the channel 40. Thus, while the cover 32 of the guide rail 24 is not illustrated in FIG. 3, it can be plainly seen from FIG. 3 that the door 16 and its attached guide follower 60 extend through the channel 40 to the interior chamber 42 of the guide rail 24 in its travel upward and downward in response to rotation of the roller 12 by the motor 14.

As can further be seen from the detailed illustration of FIG. 3, when a trans-barrier is applied to the door 16 in a direction away from wall 22 so that the door 16 and the guide follower 60 urge the cover 32 outward about its hinge 34, there is occasion for the guide follower 60 to snarl, tangle, or stretch the cable 46 and cause serious damage to the tensioning mechanism 44 to the extent that significant down time with the door 16 jammed in its downward (closed) position is a distinct possibility. It is this shortcoming of the design of the prior art door mechanism illustrated in FIGS. 1, 2, and 3 which the present invention overcomes.

Figure 4:
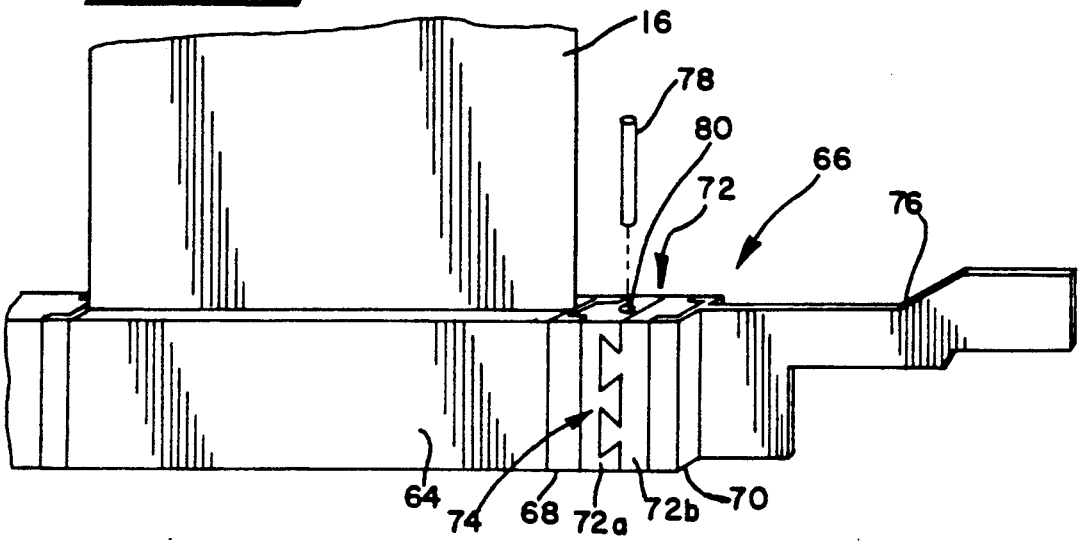
FIG. 4 is a perspective view of the preferred embodiment of the present invention.

FIG. 4 illustrates a perspective view of the preferred embodiment of the present invention. In FIG. 4, a flexible door 16 is illustrated with a leading edge segment 64 attached at the bottom of the flexible door 16. The leading edge segment 64 extends the full width of the flexible door 16 and is attached to a guide follower 66.

The preferred embodiment of the guide follower 66 includes a pair of U-shaped brackets 68 and 70 oriented in facing relation and embracing a sliding block assembly 72. The sliding block assembly 72 is comprised of two portions **72*a* and 72*b* of material preferably having a low coefficient of friction, such as urethane or the like, and joined in a multi-dovetail joint 74**.

The U-shaped bracket 68 may be unitarily formed with the leading edge segment 64 or may be attached by bolting, adhesive, or other commonly known means to the leading edge segment 64. A guide follower arm 76 may be similarly unitarily formed with the U-shaped bracket 70 or attached to the U-shaped bracket 70. The guide follower arm 76 extends substantially perpendicularly from the U-shaped bracket 70 and is configured to slidingly engage a guide rail structure adjacent an opening and accommodate a tensioning mechanism in the manner previously known and illustrated in FIGS. 1-3.

Also included in the preferred embodiment of the guide follower 66 is shear pin 78 configured to be inserted in an aperture 80. The aperture 80 is oriented to intersect the dovetail joint 74 substantially throughout the length of the dovetail joint 74 so as to intersect the mating surfaces established at the boundaries of the sliding block assembly portion **72*a* and sliding block assembly portion 72*b***, as will be described in greater detail hereinafter.

The sliding block assembly 72 is retained between the facing U-shaped brackets 68 and 70 by means generally known in the industry, such as bolting (not shown in FIG. 4), adhesive, or the like.

Figure 6:
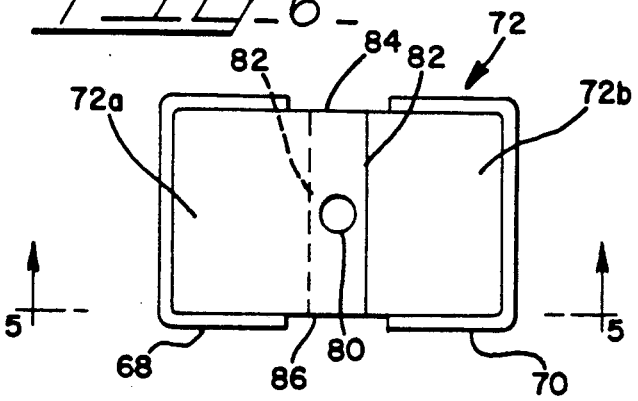
FIG. 6 is a top view of the sliding block assembly of the preferred embodiment of the present invention.
Figure 5:
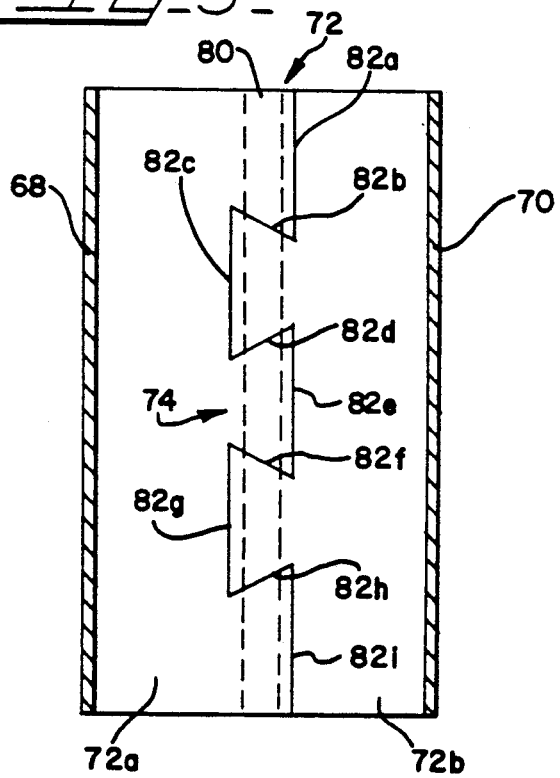
FIG. 5 is a plan section view of the sliding block assembly of the present invention, taken along Section 5—5 of FIG. 6.

FIG. 5 illustrates a plan section view of the sliding block assembly of the preferred embodiment of the present invention. In FIG. 5, the sliding block assembly 72 is held between the two U-shaped brackets 68 and 70 and the dovetail joint 74 establishes pairs of mating surfaces **82*a*-82*i*. As may be seen in FIG. 6, in a top view of the preferred embodiment of the sliding block assembly illustrated in FIG. 5, the plurality of mating surfaces 82*a*-82*i* are substantially perpendicular to the two faces 84 and 86 of the sliding block assembly 72. Using such a construction for the sliding block assembly 72, the sliding block assembly 72 will separate into a first portion comprising U-shaped bracket 68 and sliding block assembly portion 72*a* and a second portion comprising U-shaped bracket 70 with its attached guide follower arm 76 and sliding block assembly portion 72*b* upon application of a force, for example, against the leading edge segment 64 of the door 16 in either of the two directions substantially perpendicular to the leading edge segment 64. Thus, a fork lift or other machine impacting the leading edge segment 64 of the door 16 from either side of the door 16 will, if the force is of sufficient magnitude, shear the shear pin 78 (referring to FIG. 4) and effect a sliding disengagement of the two portions 72*a* and 72*b* of the sliding block assembly 72**.

Preferably, the material of the sliding block assembly 72 is selected to provide a minimal coefficient of friction in order that minimal amounts of the trans-barrier force applied to the leading edge segment 64 will be transmitted through the sliding block assembly 72 to the guide follower arm 76. In such manner, the guide follower arm 76 will impact a minimal amount on its associated guide rail and tensioning mechanism, thereby precluding damage to the guide rail and tensioning mechanism.

Returning to FIGS. 5 and 6, the aperture 80 is clearly shown as passing entirely through the sliding block assembly 72 and intersecting pairs of mating surfaces **82*b*, 82*d*, 82*f*, and 82*h*. Proper selection of the shear pin material, diameter, and other parameters serves to precisely define the amount of trans-barrier force which must be applied to the sliding block assembly 72** in order to effect sliding disengagement of sliding block assembly portion 72*a* and 72*b*.

Figure 7:
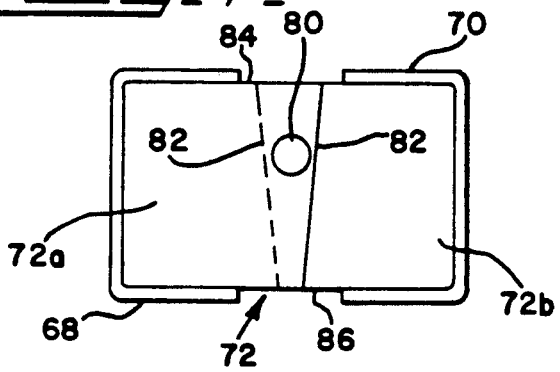
FIG. 7 is a top view of the sliding block assembly of an alternate embodiment of the present invention which is configured to respond to trans-barrier forces in one direction only.

FIG. 7 illustrates an alternate embodiment of the apparatus of the present invention in the form of an alternate top view of the sliding block assembly illustrated in FIG. 5. In FIG. 7, the pairs of mating surfaces 82 are not perpendicular to the faces 84 and 86 of the sliding block assembly 72, and, thus, the sliding block assembly 72 will only slidingly disengage in one direction in response to a trans-barrier force.

Figure 8:
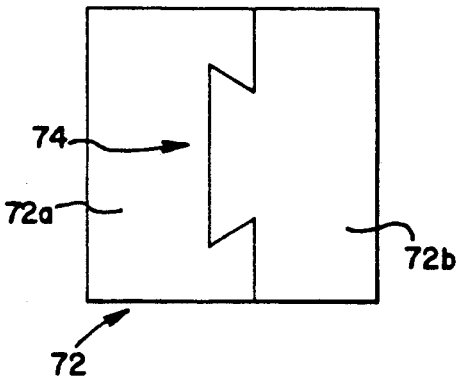
FIG. 8 is a plan view of the sliding block assembly of an alternate embodiment of the present invention in which the interface between the first portion and second portion of the apparatus comprises a single dovetail joint.

FIG. 8 is a plan view of the sliding block assembly 72 of an alternate embodiment of the present invention where the sliding block assembly portion 72*a* and the sliding block assembly portion 72*b* are joined by a single dovetail joint 74.

Figure 9:
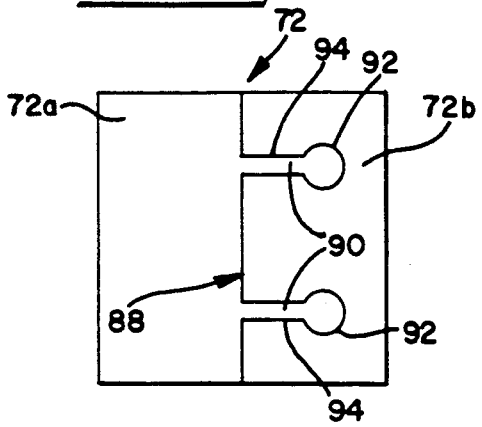
FIG. 9 is a plan view of the sliding block assembly of an alternate embodiment of the present invention in which the interface between the first portion and the second portion of the apparatus comprises a pair of bulbous-ended walls and complementary receiving channels.

FIG. 9 is a plan view of an alternate embodiment of the sliding block assembly 72 of the present invention wherein the sliding block assembly portion 72*a* and the sliding block assembly portion 72*b* are joined in a joint 88 comprising a pair of walls 90 having bulbous ends 92 with the walls 90 and ends 92 being received within complementary channels 94 in sliding block assembly portion 72*b*.

Figure 10:
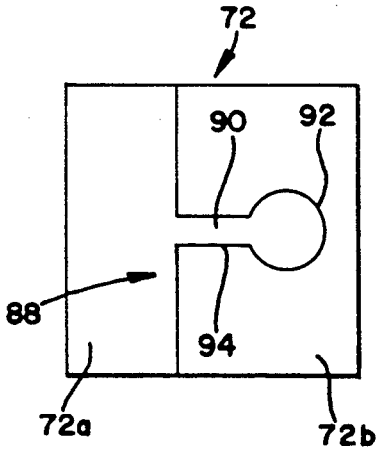
FIG. 10 is a plan view of the sliding block assembly of an alternate embodiment of the present invention in which the interface between the first portion and second portion of the apparatus comprises a single bulbous-ended wall and complementary receiving channel.

FIG. 10 is a plan view of an alternate embodiment of the sliding block assembly 72 of the present invention wherein the sliding block assembly portion 72*a* is joined with the sliding block assembly portion 72*b* by a joint 88 comprising a single wall 90 having a bulbous end 92 with the wall 90 and the end 92 being received within a complementary channel 94 in sliding block assembly portion 72*b*.

Figure 11:
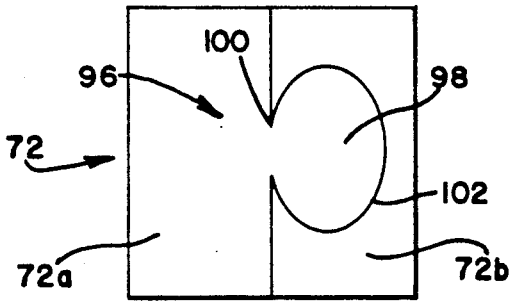
FIG. 11 is a plan view of the sliding block assembly of an alternate embodiment of the present invention in which the interface between the first portion and the second portion of the apparatus comprises a tangential rod and complementary receiving channel.

FIG. 11 is a plan view of an alternate embodiment of the sliding block assembly 72 of the present invention wherein the sliding block assembly portion 72*a* and the sliding block assembly portion 72*b* are joined by a joint 96 comprising a tangential rod 98 joined to the remainder of sliding block assembly portion 72*a* by a neck 100 with the tangential rod 98 being received within a complementary channel 102 in sliding block assembly portion 72*b*.

Figure 12:
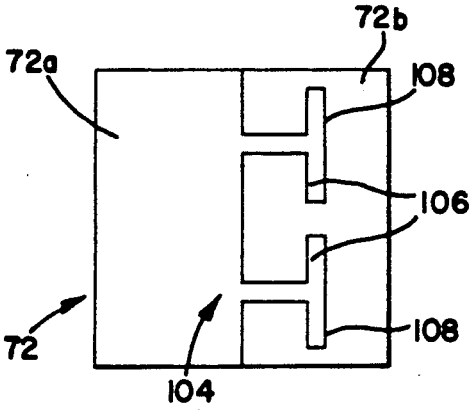
FIG. 12 is a plan view of the sliding block assembly of an alternate embodiment of the present invention in which the interface between the first portion and second portion of the apparatus comprises a pair of walls having a T-shaped cross section and complementary receiving channels.

FIG. 12 is a plan view of an alternate embodiment of the sliding block assembly 72 of the present invention wherein sliding block assembly portion 72*a* and sliding block assembly portion 72*b* are joined by a joint 104 which comprises a pair of walls 106 of generally T-shaped cross-section with the walls 106 being received within complementary channels 108 in sliding block assembly portion 72*b*.

Figure 13:
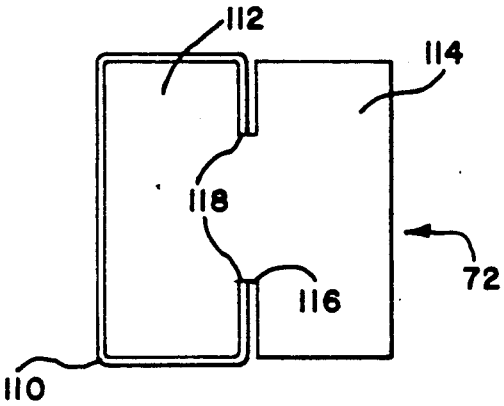
FIG. 13 is a plan view of the sliding block assembly of an alternate embodiment of the present invention in which the interface between the first portion and second portion of the apparatus comprises a metal C-shaped channel and a pendant mating block slidable within that channel.

FIG. 13 is a plan view of an alternate embodiment of the sliding block assembly 72 of the present invention wherein the sliding block assembly comprises a generally C-shaped metal channel 110 and a mating block 112 slidable within the channel 110. The mating block 112 is joined to a base sliding section 114 at a neck 116. The neck 116 slidingly engages the free ends 118 of the C-shaped channel 110.

Figure 14:
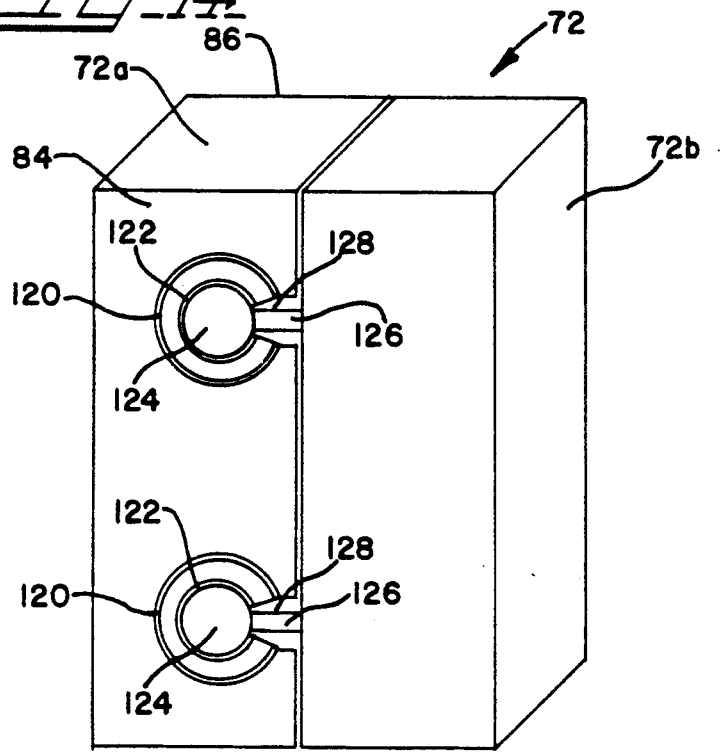
FIG. 14 is a perspective view of the sliding block assembly of an alternate embodiment of the present invention in which the interface between the first portion and second portion of the apparatus comprises embedded linear bearing assemblies.

FIG. 14 is a perspective view of an alternate embodiment of the sliding block assembly 72 of the present invention. In the embodiment illustrated in FIG. 14, the sliding block assembly portion 72*a* has embedded therein a pair of linear bearing housings 120 presenting inner races 122. The linear bearings 120 and their associated inner races 122 are open to the faces 84 and 86 of the sliding block assembly 72. Slidingly received within the inner races 122 are linear bearing cores 124. The linear bearing cores 124 are attached by extensions 126 through slots 128 to sliding block assembly portion 72*b*. Preferably, the extensions 126 are embedded in the sliding block assembly portion 72*b* to rigidly affix the linear bearing cores 124 with respect to the sliding block assembly portion 72*b*.

The alternate embodiment illustrated in FIG. 14 is particularly useful obviating any effects of plastic creep or excessive frictional wear which may be experienced by some materials from which the sliding block assembly 72 may be manufactured. Such plastic creep or frictional wear could occasion misalignment with consequent jamming or loose fitting of the sliding block assembly portion 72*a* with sliding block assembly portion 72*b*.

Figure 15:
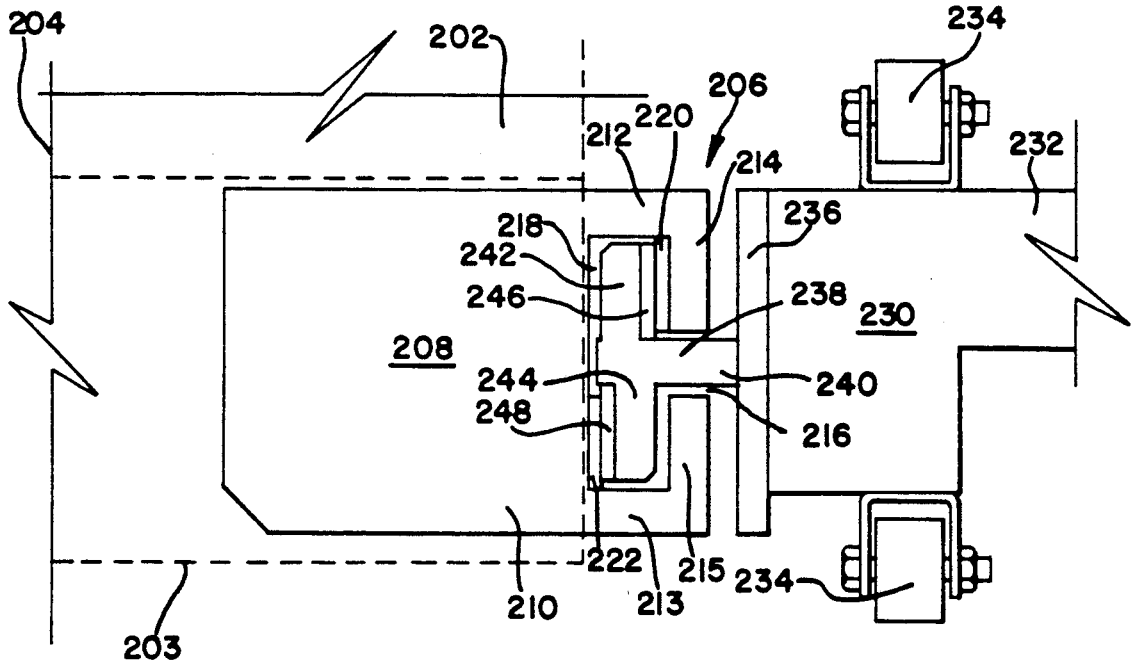
FIG. 15 is a plan view of an alternate embodiment of the present invention with a portion of an associated door shown in phantom.

FIG. 15 is a plan illustration of an alternate embodiment of the present invention with a portion of an associated door shown in phantom.

In FIG. 15, a portion of a flexible door 202 is shown in phantom having a leading edge segment 204 attached at the bottom 203 of the flexible door 202. The leading edge segment 204 extends the full width of the flexible door 202 (not shown) and is attached to a guide follower 206.

The guide follower 206 includes a C-shaped door bracket 208. Door bracket 208 comprises a base section 210 having integrally formed depending arms 212, 213 and, depending in facing relationship respectively from depending arms 212, 213 are facing arms 214, 215. Facing arms 214, 215 are of appropriate length to leave a gap 216 therebetween. Thus, there is defined a cavity 218 which is bounded by the depending arms 212, 213, facing arms 214, 215 and base section 210, with access to cavity 218 being available through gap 216. On facing arm 214 is affixed a sliding block 220 within cavity 218, and a similar sliding block 222 is affixed to the lower portion of the boundary of cavity 218 provided by base section 210.

Guide follower 206 also includes a rail bracket 230. Rail bracket 230 includes a guide follower arm 232 on which are mounted a pair of rollers 234, and a rail base member 236. Depending substantially perpendicularly from rail base member 236 is a generally T-shaped sliding member 238. Sliding member 238 is comprised of a generally horizontally oriented bar 240 and depending generally vertically in opposing directions from the end of bar 240, distal from rail base member 236, are sliding block support members 242 and 244. Sliding block support member 242 carries thereon a sliding block 246 which is affixed in facing relationship to sliding block 220; sliding block support member 244 has affixed thereon a sliding block 248 in facing relationship to sliding block 222.

Cavity 218, sliding member 238, and sliding blocks 220, 246, 222, 248 are all appropriately sized to present sliding blocks 220 and 246 in facing relationship and substantially intimate contact, and sliding blocks 222 and 248 in facing relationship and substantially intimate contact when door 202 is in proper operating position with respect to rail bracket 230. When in such operating position, there exists a gap between sliding block support member 242 and base section 210 as well as a gap between sliding block support member 244 and its adjacent facing arm 215. These gaps, and the loose fit of bar 240 within gap 216 facilitate reassembly of guide follower 206 by tilting rail bracket 230 with respect to door bracket 208 while inserting sliding member 238 and its associated siding block support members 242, 244 within the gap 216 and the cavity 218, then allowing rail bracket 232 to tilt in the opposite direction to the insertion-imposed tilt to bring the associated members in the alignment illustrated in FIG. 15 for operation of door 202.

Thus, when a lateral force (e.g., in a direction perpendicular to the plane of FIG. 15) is applied to leading edge segment 204 of flexible door 202, door bracket 208 and rail bracket 230 are slidably disengaged from each other, which disengagement is facilitated by the low coefficient of friction material of which the sliding blocks 220, 246 and 222, 248 are preferably manufactured. Thus, injury to door 202 is minimized.

A strap, substantially the width of depending arms 212, 213 may be wrapped about door bracket 208 while rail bracket 230 is inserted therein as illustrated in FIG. 15 in order to ensure that inadvertent sliding disengagement of door bracket 208 and real bracket 230 is not occasioned by vibration, inadvertent nudging of leading edge segment 204, or the like. Preferably, such a strap would be secured in its wrapped position about door bracket 208 by a releasable fastener, such as hook-and-eye fastening lands, or the like.

The placement of sliding blocks 220, 246 and 222, 248 is selected appropriately that when door 202 and guide follower 206 are in proper operating engagement with ancillary operating parts (not shown) there are opposing moment arms applied to door bracket 208 and rail bracket 230 which urge sliding blocks 220 and 246 together as well as urge sliding blocks 222 and 248 together.

Figure 16:
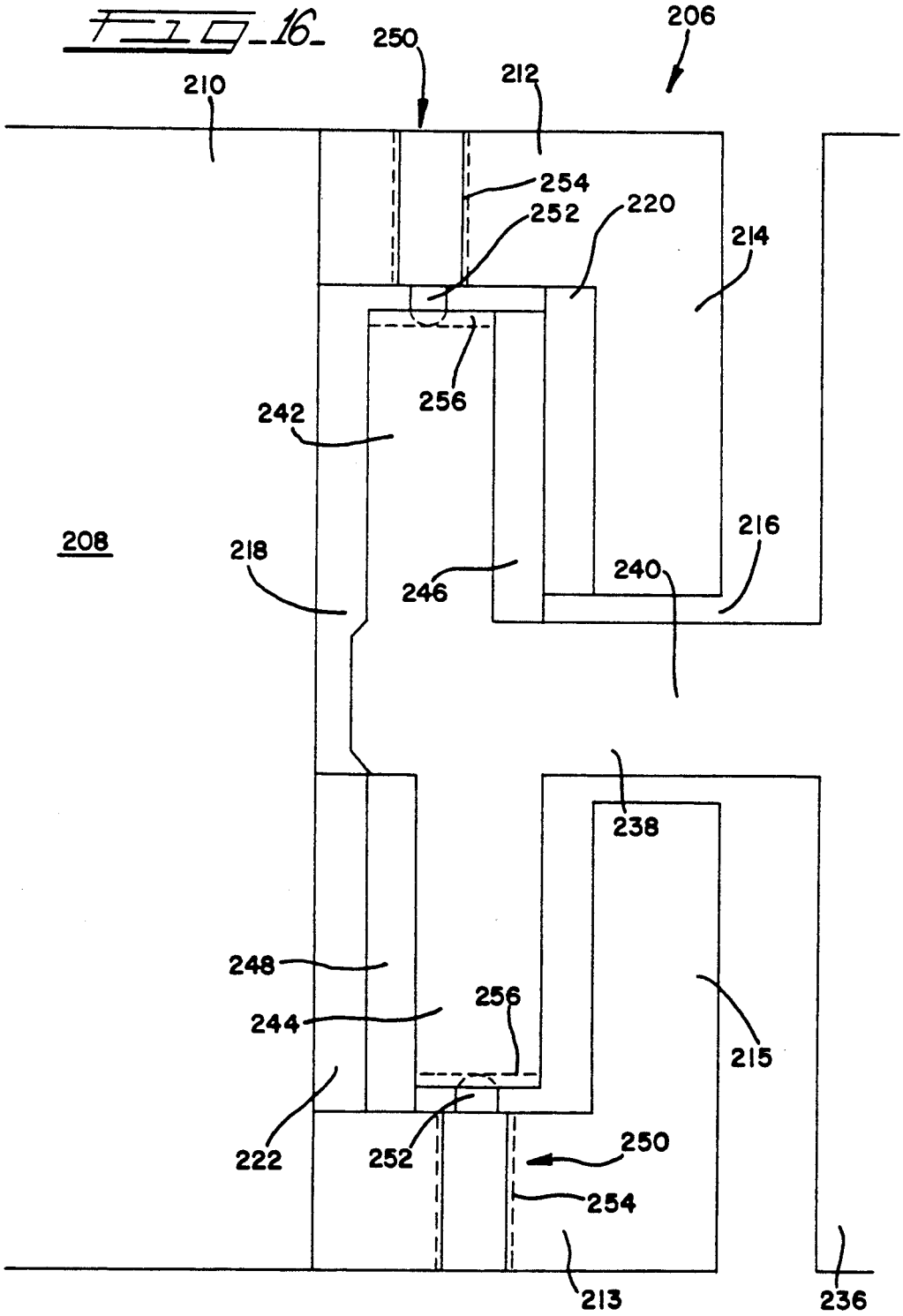
FIG. 16 is a plan view of details of an alternate embodiment of the present invention.

In continuing with facilitating clarity and ease of understanding of the invention, like elements in FIGS. 15 and 16 will be identified by like reference numerals.

FIG. 16 is a plan view of details of an alternate embodiment of the present invention illustrated in FIG. 15. In FIG. 16, a guide follower 206 is illustrated comprising a C-shaped door bracket 208 and an associated interfitting T-shaped sliding member 238 within a cavity 218. Cavity 218 is defined by depending arms 212, 213 and facing arms 214, 215 of C-shaped door bracket 208.

As previously described, T-shaped sliding member 238 is comprised of a horizontal bar 240 and, depending from horizontal bar 240, sliding block support members 242, 244. Sliding block support members 242, 244 respectively carry thereon sliding blocks 246, 248; facing arm 214 and base section 210 of C-shaped door bracket 208 support sliding blocks 220, 222 in facing relation with sliding blocks 246, 248.

In the alternate embodiment of FIG. 16, a pair of bias assemblies 250 are employed to bias T-shaped sliding member 238 at a desired position within cavity 218. Each bias assembly 250 comprises a biased plunger 252 deployed within a cavity 254 and biasedly urged to engage a receptacle 256. Receptacles 256 are preferably associated with the ends of sliding block support members 242, 244. Receptacles 256 preferably comprise an integrally formed channel in the ends of sliding block support members 242, 244. Each receptacle 256 has a depth appropriate to establish a detent-type engagement with its respective biased plunger 252. Thus, application of a force in excess of a predetermined magnitude transverse to a barrier employing the apparatus of FIG. 16 (i.e., transverse to the plane of the illustration of FIG. 16) will overcome the bias exerted by biased plunger 252, causing plunger 252 to retract within its cavity 254, thereby eliminating the detent interference fit between bias plunger 252 and receptacle 256 and allowing transverse displacement of T-shaped sliding member 238 within cavity 218.

It is to be understood that, while the detailed drawings and specific examples given describe preferred embodiments of the invention, they are for the purpose of illustration only, that the apparatus of the invention is not limited to the precise details and conditions disclosed, and that various changes may be made therein without departing from the spirit of the invention which is defined by the following claims.

I claim:

1. An apparatus for controlling passage through an opening comprising a movable barrier means for selectively blocking said opening;

at least one guide means for guiding said movable barrier means;

and at least one guide follower means for effecting operative connection between said movable barrier means and said at least one guide means, said at least one guide follower means being attached to said movable barrier means and operatively interactive with said at least one guide means to control movement of said movable barrier means;

each of said at least one guide follower means comprising a first portion attached to said movable barrier means and a second portion, said first portion being slidingly separable from said second portion in a direction transverse to said movable barrier means in response to application of a predetermined force to said first portion transverse to said movable barrier means.

2. An apparatus for controlling passage through an opening as recited in claim 1 wherein said movable barrier means generally moves in a plane to effect said blocking;

and said first portion and said second portion interfit to define at least one pair of mating surfaces, each of said at least one pair of mating surfaces being transverse to said plane, said at least one pair of mating surfaces being oriented to allow disengagement of said first portion and said second portion in two directions, said two directions being transverse to said plane.

3. An apparatus for controlling passage through an opening as recited in claim 2 wherein each of said at least one guide follower means further comprises a frangible pin means for securing said first portion to said second portion, said frangible pin means intersecting at least one of said at least one pair of mating surfaces, said frangible pin means being configured to fail in response to said application of said predetermined force.

4. An apparatus for controlling passage through an opening as recited in claim 2 wherein each of said at least one guide follower means further comprises temporary holding means for maintaining a predetermined relative orientation of said first portion and said second portion, said temporary holding means ceasing to maintain said predetermined relative orientation in response to said application of said predetermined force.

5. An apparatus for controlling passage through an opening as recited in claim 1 wherein said movable barrier means has a width and said movable barrier means includes a leading edge segment, said leading edge segment extending substantially across said width;

said first portion being attached to said leading edge segment.

6. An apparatus for controlling passage through an opening as recited in claim 2 wherein said movable barrier means has a width and said movable barrier means includes a leading edge segment, said leading edge segment extending substantially across said width;

said first portion being attached to said leading edge segment.

7. An apparatus for controlling passage through an opening as recited in claim 3 wherein said movable barrier means has a width and said movable barrier means includes a leading edge segment, said leading edge segment extending substantially across said width;

said first portion being attached to said leading edge segment.

8. An apparatus for controlling passage through an opening as recited in claim 4 wherein said movable barrier means has a width and said movable barrier means includes a leading edge segment, said leading edge segment extending substantially across said width;

said first portion being attached to said leading edge segment.

9. An apparatus for controlling passage through an opening as recited in claim 1 wherein said movable barrier means generally moves in a plane to effect said blocking; and said first portion and said second portion interfit to define at least one pair of mating surfaces, each of said at least one pair of mating surfaces being transverse to said plane, said at least one pair of mating surfaces being oriented to allow disengagement of said first portion and said second portion in one direction, said direction being transverse to said plane.

10. An apparatus for controlling passage through an opening as recited in claim 9 wherein each of said at least one guide follower means further comprises a frangible pin means for securing said first portion to said second portion, said frangible pin means intersecting at least one of said at least one pair of mating surfaces, said frangible pin means being configured to fail in response to said application of said predetermined force.

11. An apparatus for controlling passage through an opening as recited in claim 9 wherein each of said at least one guide follower means further comprises temporary holding means for maintaining a predetermined relative orientation of said first portion and said second portion, said temporary holding means ceasing to maintain said predetermined relative orientation in response to said application of said predetermined force.

12. An apparatus for controlling passage through an opening as recited in claim 9 wherein said movable barrier means has a width and said movable barrier means includes a leading edge segment, said leading edge segment extending substantially across said width;

said first portion being attached to said leading edge segment.

13. An apparatus for controlling passage through an opening as recited in claim 10 wherein said movable barrier means has a width and said movable barrier means includes a leading edge segment, said leading edge segment extending substantially across said width;

said first portion being attached to said leading edge segment.

14. An apparatus for controlling passage through an opening as recited in claim 11 wherein said movable barrier means has a width and said movable barrier means includes a leading edge segment, said leading edge segment extending substantially across said width;

said first portion being attached to said leading edge segment.

15. An apparatus for accommodating application of a force in excess of a predetermined magnitude to preclude damage to a closure assembly, said closure assembly including a generally planar movable barrier means for controlling access through an opening and at least one guide means disposed about said opening for guiding said movable barrier means, the apparatus comprising at least one guide follower means for operably connecting said movable barrier means and said at least one guide means, each of said at least one guide follower means including a first portion attached to said movable barrier means and a second portion operatively interactive with said at least one guide means, said first portion being slidingly separable from said second section in a direction transverse to said movable barrier means upon said application of said force in excess of said predetermined magnitude generally in said direction.

16. An apparatus for accommodating application of a force in excess of a predetermined magnitude as recited in claim 15 wherein said first portion and said second portion interfit to form at least one pair of mating surfaces, each of said at least one pair of mating surfaces being transverse to said movable barrier means, said at least one pair of mating surfaces being oriented to allow disengagement of said first portion and said second portion in two directions, said two directions being transverse to said plane.

17. An apparatus for accommodating application of a force in excess of a predetermined magnitude as recited in claim 15, wherein the apparatus further comprises a frangible pin means for securing said first portion and said second portion, said frangible pin means intersecting at least one of said at least one pair of mating surfaces, said frangible pin means being configured to fail upon said application of said force in excess of said predetermined magnitude.

18. An apparatus for accommodating application of a force in excess of a predetermined magnitude as recited in claim 15, wherein the apparatus further comprises temporary retaining means for maintaining a predetermined relative orientation of said first portion and said second portion, said retaining means being configured to cease maintaining said predetermined relative orientation upon said application of said force in excess of said predetermined magnitude.

19. An apparatus for accommodating application of a force in excess of a predetermined magnitude as recited in claim 15 wherein one of said first portion and said second portion comprises a generally C-shaped member having a base section, a pair of arms depending from said base section, and a pair of facing arms depending from said arms defining a cavity bounded by said base section, said arms, and said facing arms; said facing arms defining a gap between said facing arms, said gap providing an access to said cavity; the other of said first portion and said second portion comprising a generally T-shaped member having a base member and a cross member, said generally T-shaped member and said generally C-shaped member being appropriately proportioned whereby said base member may traverse said gap and said cross member may effect operative sliding engagement within said cavity.

20. An apparatus for accommodating application of a force in excess of a predetermined magnitude as recited in claim 19 wherein said cross member comprises a first segment and a second segment, said first segment and said second segment depending in substantially opposite directions from said base member, said operative sliding engagement being established between said base section and one segment of said first segment and said second segment, and between one facing arm of said pair of facing arms and the other segment of said first segment and said second segment.

21. An apparatus for accommodating application of a force in excess of a predetermined magnitude as recited in claim 20 wherein, when said operative sliding engagement is established, a first gap is established between said one segment and the other facing arm of said pair of facing arms, and a second gap is established between said other segment and said base section, whereby said generally T-shaped member may be tiltingly positioned within said cavity and rotated to establish said operative sliding engagement.

22. An apparatus for accommodating application of a force in excess of a predetermined magnitude as recited in claim 19 wherein the apparatus further comprises bias means for biasing said generally T-shaped member at a desired position within said cavity, said bias means establishing a yieldable interference between said generally T-shaped member and said generally C-shaped member.

23. An apparatus for accommodating application of a force in excess of a predetermined magnitude as recited in claim 22 wherein said bias means comprises at least one bias assembly, each said at least one bias assembly comprising a retention member and an associated receptacle, said retention member biasedly engaging said receptacle when said generally T-shaped member is situated at said desired position; said retention member yieldingly disengaging said receptacle in response to said application of said force in excess of a predetermined magnitude in a direction transverse to said movable barrier means.

24. An apparatus for accommodating application of a force in excess of a predetermined magnitude as recited in claim 23 wherein said cross member comprises a pair of segments, said pair of segments depending in substantially opposite directions from said base member; and said at least one bias assembly comprises two bias assemblies, each of said two bias assemblies being associated with a different of said pair of segments.

25. An apparatus for accommodating application of a force in excess of a predetermined magnitude as recited in claim 23 wherein said retention member comprises a biased plunger, said plunger being affixed to said generally C-shaped member and being biasedly urged toward said generally T-shaped member.

26. An apparatus for accommodating application of a force in excess of a predetermined magnitude as recited in claim 25 wherein said receptacle comprises a depression integrally formed in said generally T-shaped member, said depression being appropriately proportioned and appropriately positioned to detentedly hold said generally T-shaped member at said desired position.

27. An apparatus for accommodating application of a force in excess of a predetermined magnitude as recited in claim 23 wherein said retention member comprises a biased plunger, said plunger being affixed to one of said generally C-shaped member and said generally T-shaped member, said plunger being biasedly urged toward another of said generally C-shaped member and said generally T-shaped member, and said receptacle comprises a depression integrally formed in said other of said generally C-shaped member and said generally T-shaped member, said depression having appropriately positioned to detentedly hold said generally T-shaped member at said desired position.

28. An apparatus for accommodating application of a force in excess of a predetermined magnitude as recited in claim 27 wherein said at least one bias assembly comprises two bias assemblies.

29. An apparatus configured for maintaining a barrier in a position against a trans-barrier force less than a predetermined magnitude, said barrier having associated structure means for cooperating with the apparatus to define said position, the apparatus comprising a guide follower means attached to said barrier and operatively interacting with said structure means for defining said position, said guide follower means comprising a first portion attached to said barrier and a second portion operatively interactive with said structure means, said first portion and said second portion being in an interfitting relation and defining at least one pair of mating surfaces, each of said at least one pair of mating surfaces being transverse to said barrier and oriented to allow sliding disengagement of said first portion from said second portion in a direction transverse to said barrier in response to application of a trans-barrier force to said barrier in excess of said predetermined magnitude.

30. An apparatus for controlling passage through an opening comprising a movable barrier means for selectively blocking said opening;

at least one guide means for guiding said movable barrier means;

and at least one guide follower means for effecting operative connection between said movable barrier means and said at least one guide means, said at least one guide follower means being attached to said movable barrier means and operatively interactive with said at least one guide means to control movement of said movable barrier means;

each of said at least one guide follower means comprising a first portion attached to said movable barrier means and a second portion, said first portion and said second portion being separable in response to application of a predetermined force to said first portion transverse to said movable barrier means;

said movable barrier means generally moving in a plane to effect said blocking;

said first portion and said second portion interfitting to define at least one pair of mating surfaces, each of said at least one pair of mating surfaces being transverse to said plane, said at least one pair of mating surfaces being oriented to allow disengagement of said first portion and said second portion in two directions, said two directions being transverse to said plane;

each of said at least one guide follower means further comprising a frangible pin means for securing said first portion to said second portion, said frangible pin means intersecting at least one of said at least one pair of mating surfaces, said frangible pin means being configured to fail in response to said application of said predetermined force.

31. An apparatus for controlling passage through an opening as recited in claim 30 wherein said movable barrier means has a width and said movable barrier means includes a leading edge segment, said leading edge segment extending substantially across said width;

said first portion being attached to said leading edge segment.

32. An apparatus for controlling passage through an opening comprising a movable barrier means for selectively blocking said opening;

at least one guide means for guiding said movable barrier means;

and at least one guide follower means for effecting operative connection between said movable barrier means and said at least one guide means, said at least one guide follower means being attached to said movable barrier means and operatively interactive with said at least one guide means to control movement of said movable barrier means;

each of said at least one guide follower means comprising a first portion attached to said movable barrier means and a second portion, said first portion and said second portion being separable in response to application of a predetermined force to said first portion transverse to said movable barrier means;

said movable barrier means generally moving in a plane to effect said blocking; and said first portion and said second portion interfitting to define at least one pair of mating surfaces, each of said at least one pair of mating surfaces being transverse to said plane, said at least one pair of mating surfaces being oriented to allow disengagement of said first portion and said second portion in one direction, said direction being transverse to said plane;

each of said at least one guide follower means further comprising a frangible pin means for securing said first portion to said second portion, said frangible pin means intersecting at least one of said at least one pair of mating surfaces, said frangible pin means being configured to fail in response to said application of said predetermined force.

33. An apparatus for controlling passage through an opening as recited in claim 32 wherein said movable barrier means has a width and said movable barrier means includes a leading edge segment, said leading edge segment extending substantially across said width; said first portion being attached to said leading edge segment.

34. An apparatus for accommodating application of a force in excess of a predetermined magnitude to preclude damage to a closure assembly, said closure assembly including a generally planar movable barrier means for controlling access through an opening and at least one guide means disposed about said opening for guiding said movable barrier means, the apparatus comprising at least one guide follower means for operably connecting said movable barrier means and said at least one guide means, each of said at least one guide follower means including a first portion attached to said movable barrier means and a second portion operatively interactive with said at least one guide means, said first portion and said second portion being separable upon said application of said force in excess of said predetermined magnitude in a direction transverse to said movable barrier means;

the apparatus further comprising a frangible pin means for securing said first portion and said second portion, said frangible pin means intersecting at least one of said at least one pair of mating surfaces, said frangible pin means being configured to fail upon said application of said force in excess of said predetermined magnitude.

35. An apparatus for accommodating application of a force in excess of a predetermined magnitude to preclude damage to a closure assembly, said closure assembly including a generally planar movable barrier means for controlling access through an opening and at least one guide means disposed about said opening for guiding said movable barrier means, the apparatus comprising at least one guide follower means for operably connecting said movable barrier means and said at least one guide means, each of said at least one guide follower means including a first portion attached to said movable barrier means and a second portion operatively interactive with said at least one guide means, said first portion and said second portion being separable upon said application of said force in excess of said predetermined magnitude in a direction transverse to said movable barrier means;

one of said first portion and said second portion comprising a generally C-shaped member having a base section, a pair of arms depending from said base section, and a pair of facing arms depending from said arms defining a cavity bounded by said base section, said arms, and said facing arms; said facing arms defining a gap between said facing arms, said gap providing an access to said cavity; the other of said first portion and said second portion comprising a generally T-shaped member having a base member and a cross member, said generally T-shaped member and said generally C-shaped member being appropriately proportioned whereby said base member may traverse said gap and said cross member may effect operative sliding engagement within said cavity.

36. An apparatus for accommodating application of a force in excess of a predetermined magnitude as recited in claim 35 wherein said cross member comprises a first segment and a second segment, said first segment and said second segment depending in substantially opposite directions from said base member, said operative sliding engagement being established between said base section and one segment of said first segment and said second segment, and between one facing arm of said pair of facing arms and the other segment of said first segment and said second segment.

37. An apparatus for accommodating application of a force in excess of a predetermined magnitude as recited in claim 36 wherein, when said operative sliding engagement is established, a first gap is established between said one segment and the other facing arm of said pair of facing arms, and a second gap is established between said other segment and said base section, whereby said generally T-shaped member may be tiltingly positioned within said cavity and rotated to establish said operative sliding engagement.

38. An apparatus for accommodating application of a force in excess of a predetermined magnitude as recited in claim 35 wherein the apparatus further comprises bias means for biasing said generally T-shaped member at a desired position within said cavity, said bias means establishing a yieldable interference between said generally T-shaped member and said generally C-shaped member.

39. An apparatus for accommodating application of a force in excess of a predetermined magnitude as recited in claim 38 wherein said bias means comprises at least one bias assembly, each said at least one bias assembly comprising a retention member and an associated receptacle, said retention member biasedly-engaging said receptacle when said generally T-shaped member is situated at said desired position; said retention member yieldingly disengaging said receptacle in response to said application of said force in excess of predetermined magnitude in a direction transverse to said movable barrier means.

40. An apparatus for accommodating application of a force in excess of a predetermined magnitude as recited in claim 39 wherein said cross member comprises a pair of segments, said pair of segments depending in substantially opposite directions from said base member; and said at least one bias assembly comprises two bias assemblies, each of said two bias assemblies being associated with a different of said pair of segments.

41. An apparatus for accommodating application of a force in excess of a predetermined magnitude as recited in claim 39 wherein said retention member comprises a biased plunger, said plunger being affixed to said generally C-shaped member and being biasedly urged toward said generally T-shaped member.

42. An apparatus for accommodating application of a force in excess of a predetermined magnitude as recited in claim 41 wherein said receptacle comprises a depression integrally formed in said generally T-shaped member, said depression being appropriately proportioned and appropriately positioned to detentedly hold said generally T-shaped member at said desired position.

43. An apparatus for accommodating application of a force in excess of a predetermined magnitude as recited in claim 39 wherein said retention member comprises a biased plunger, said plunger being affixed to one of said generally C-shaped member and said generally T-shaped member, said plunger being biasedly urged toward another of said generally C-shaped member and said generally T-shaped member, and said receptacle comprises a depression integrally formed in said other of said generally C-shaped member and said generally T-shaped member, said depression being appropriately positioned to detentedly hold said generally T-shaped member at said desired position.

44. An apparatus for accommodating application of a force in excess of a predetermined magnitude as recited in claim 43 wherein said at least one bias assembly comprises two bias assemblies.

* * * * *